US011624372B2

(12) United States Patent
Uni

(10) Patent No.: US 11,624,372 B2
(45) Date of Patent: Apr. 11, 2023

(54) CENTRIFUGAL BLOWER

(71) Applicant: SHINANO KENSHI KABUSHIKI KAISHA, Nagano (JP)

(72) Inventor: Masahiko Uni, Nagano (JP)

(73) Assignee: SHINANO KENSHI KABUSHIKI KAISHA, Nagano (JP)

( * ) Notice: Subject to any disclaimer, the term of this patent is extended or adjusted under 35 U.S.C. 154(b) by 17 days.

(21) Appl. No.: 17/160,947

(22) Filed: Jan. 28, 2021

(65) Prior Publication Data

US 2021/0239127 A1 Aug. 5, 2021

(30) Foreign Application Priority Data

Feb. 4, 2020 (JP) ..... JP2020-016949
Nov. 30, 2020 (JP) ..... JP2020-198027

(51) Int. Cl.
*F04D 17/10* (2006.01)
*F04D 29/42* (2006.01)
*F04D 29/44* (2006.01)

(52) U.S. Cl.
CPC ..... *F04D 29/4206* (2013.01); *F04D 17/10* (2013.01); *F04D 29/441* (2013.01)

(58) Field of Classification Search
CPC ..... F04D 17/10; F04D 17/16–168; F04D 17/165; F04D 25/088; F04D 29/4206; F04D 29/4226; F04D 29/4253; F04D 29/441; F04D 29/444; F24F 13/06; F24F 13/10; F24F 13/15
See application file for complete search history.

(56) References Cited

U.S. PATENT DOCUMENTS

| | | | | |
|---|---|---|---|---|
| 9,121,408 | B2 * | 9/2015 | Shioda | F04D 17/08 |
| 9,752,816 | B2 * | 9/2017 | Hwang | F24F 1/0022 |
| 10,124,135 | B2 * | 11/2018 | Kenyon | F04D 17/164 |
| 2020/0088421 | A1 * | 3/2020 | Jang | F24F 1/50 |

FOREIGN PATENT DOCUMENTS

| | | |
|---|---|---|
| JP | 2009-299636 | 12/2009 |
| JP | 2012-529585 | 11/2012 |
| JP | 2015-174580 | 10/2015 |
| JP | 2017-143737 | 8/2017 |
| JP | 2020-012381 | 1/2020 |

OTHER PUBLICATIONS

Japanese Office Action related to JP 2020-198027 dated Feb. 2, 2021.

* cited by examiner

*Primary Examiner* — Eldon T Brockman
(74) *Attorney, Agent, or Firm* — Stephen J. Weyer, Esq.; Stites & Harbison, PLLC

(57) ABSTRACT

A plurality of exhaust holes (4*f*) for exhausting compressed air to the outside of a case body (4) are drilled at a bottom portion of a second flowing path (4*e*) in a circumferential direction at prescribed intervals in an annular blowing path (8) formed by combining a first case (4*a*) and a second case (4*b*) around an outer side in a radial direction of the case body (4), and a diffuser (4*r*) inclined diagonally downward with respect to a rotation direction of a centrifugal fan (2) is provided at a position facing respective exhaust holes (4*f*).

8 Claims, 8 Drawing Sheets

CENTRIFUGAL BLOWER

CROSS-REFERENCE TO RELATED APPLICATION

This application is based upon and claims the benefit of priority of prior Japanese Patent Applications Nos. 2020-016949, filed on Feb. 4, 2020 and 2020-198027, filed on Nov. 30, 2020 and the entire contents of which are incorporated herein by reference.

TECHNICAL FIELD

The present invention relates to a centrifugal blower used for, for example, seat air conditioning or HVAC (Heating, Ventilation, and Air Conditioning) devices.

BACKGROUND ART

When a driver contacts a backrest part or a seating part of a seat for a long time, for example, in a case where the driver moves for a long distance while driving the car, air with high temperature and high humidity clings, which increases discomfort. Accordingly, a seat air conditioner for conditioning the air with high temperature and high humidity which tends to be stored chiefly in the backrest part and the seating part is used.

There are a type of seat air conditioner blowing air from the seat and a type of seat air conditioner sucking air from the seat and exhausting air. The suction-type seat air conditioner in which more comfortable air conditioning effects can be expected will be explained here. The suction-type seat air conditioner sucks air with high temperature and high humidity stored in the backrest part and the seating part and removes the air from these areas, thereby obtaining air conditioning effects.

For example, a seat air-conditioning system for suppressing noise generated when air flows into an air inlet of a blower from the seat is proposed. An inlet is formed at an upper case portion of a case assembled by screwing four corners of the upper case portion and a lower case portion, and a motor provided with a stator and a rotor and a centrifugal multiblade fan are supported in the lower case portion so as to rotate. The rotor is assembled integrally with the centrifugal multiblade fan. When the motor is rotated and the centrifugal multiblade fan is rotated, air is sucked from the inlet in the upper case portion from the seat side and is blown out from outlets opening to four sides of the case (JP-A-2015-174580).

SUMMARY OF INVENTION

Technical Problem

As the four sides of the case are opened in the configuration of the above Patent Literature 1, rigidity is extremely low. Accordingly, there is a danger that durability with respect to a stress load added to the seat and handleability such as assemblability or reliability are reduced. Specifically, there is a danger of disconnection when tension is acted on cables such as a signal line or a feeder line connected to a motor board, which reduces reliability. When ribs or the like are provided for increasing the rigidity of the case, costs are increased and fixing of a lead wire requires ingenuity; therefore, handling becomes complicated.

As a centrifugal blower, it is required to secure an air volume and a static pressure with a small and flat shape, for example, for an on-vehicle application, and further required to have a noise reduction effect.

Solution to Problem

In response to the above issue, one or more aspects of the present invention are directed to a centrifugal blower having high handleability and reliability with the small and flat shape, which is capable of securing the air volume and the static pressure and further capable of reducing noise.

In view of the above, the following embodiments are described below.

In a centrifugal blower according to the present invention in which a centrifugal fan and a motor driving the centrifugal fan to rotate are housed in a case body, and air is supplied from a central part in an axial direction of the case body and exhausted from a bottom portion on an outer side in a radial direction of the case body, the case body includes a first case assembled so as to cover the centrifugal fan, in which an opening for air supply is provided at a central part and a first blowing path is formed on the outer side in the radial direction, and a second case rotatably supporting the motor, in which a second blowing path to be combined with the first blowing path is formed on an outside of an outer peripheral end of the centrifugal fan in the radial direction, a plurality of exhaust holes for exhausting compressed air to an outside of the case body are drilled at a bottom portion of the second flowing path in a circumferential direction at prescribed intervals in an annular blowing path formed by combining the first case and the second case around the outer side in the radial direction of the case body, and a diffuser inclined diagonally downward with respect to a rotation direction of the centrifugal fan is provided at a position facing respective exhaust holes.

According to the above configuration, the case body housing the centrifugal fan and the motor driving the centrifugal fan to rotate is formed by combining the first case in which the opening for air supply is provided at the central part and the first blowing path is formed on the outer side in the radial direction, and the second case rotatably supporting the motor, in which the second blowing path to be combined with the first blowing path is formed on the outer side in the radial direction; therefore, the rigidity of the case body is high and handleability is good. An outer diameter of the centrifugal fan is increased and areas of the opening for air supply and the exhaust holes are enlarged, thereby realizing a small and flat shape in the axial direction and obtaining a flow rate even at a low rotation speed. Additionally, a partitioning wall called a tongue part does not exist in the annular blowing path formed around the outer side in the radial direction of the case body; therefore, peak sound is not generated and noise reduction can be realized.

A plurality of exhaust holes for exhausting compressed air to the outside of the case body are drilled at the bottom portion of the second flowing path in the circumferential direction at prescribed intervals in the annular blowing path; therefore, a side surface of the case body can be closed and the rigidity of the case body is improved. The compressed air sent to the annular blowing path can be efficiently exhausted by the exhaust holes drilled at plural positions in the circumferential direction; therefore, a desired air volume can be secured even with the small and flat shape. Moreover, the diffuser is provided inclined diagonally downward with respect to the rotation direction of the centrifugal fan at the position facing respective exhaust holes; therefore, the static pressure can be increased even when an exhaust flow path from the centrifugal fan to the exhaust hole is short, and the air volume can be secured when a load is generated.

The diffuser may be provided integrally with the second case, in which a plurality of diffuser plates may be arranged so that the diffuser plates adjacent in the circumferential direction do not overlap one another in plan view in the axial direction.

Accordingly, the plurality of diffuser plates are arranged so that the diffuser plates adjacent in the circumferential direction do not overlap one another in plan view in the axial direction; therefore, a desired air volume can be secured even with the small and flat shape, and the static pressure can be increased even when the exhaust flow path from the centrifugal fan to the exhaust hole is short as compared with a case where the diffuser is not provided. Moreover, the diffuser plates can be easily molded integrally with the exhaust holes in the second case easily.

The diffuser may be provided integrally with the second case, in which a plurality of diffuser plates may be arranged so that the diffuser plates adjacent in the circumferential direction overlap one another in plan view in the axial direction.

Accordingly, the plurality of diffuser plates are arranged so that the diffuser plates adjacent in the circumferential direction overlap one another in plan view in the axial direction; therefore, a required air volume can be secured even with the small and flat shape although an advanced molding technique is required, and the static pressure can be increased more even when the exhaust flow path from the centrifugal fan to the exhaust hole is short as compared with the case where the diffuser is not provided.

When an upstream end portion in an exhaust direction of each diffuser plate forming the diffuser is chamfered to form an R-surface, resistance of airflow diffused by the diffuser plates is reduced and air can be exhausted smoothly.

Each diffuser plate forming the diffuser may have a skew shape shifted by a prescribed amount in the rotating direction of the centrifugal fan with respect to the radial direction.

When the diffuser plate is formed in the skew shape, air exhausted from respective exhaust holes in the axial direction can be diffused along the rotating direction of the centrifugal fan, places where the peak sound with frequency components calculated by multiplying the number of blades of the impeller by a rotation frequency is generated can be diffused to thereby reduce noise.

It is preferable that the centrifugal fan has a hub assembled integrally with a rotor yoke at a central part, a main plate continuing from the hub on the outer side in the radial direction is formed in a dome shape, a plurality of impeller blades are formed to stand on the main plate in the circumferential direction at prescribed intervals, and a shroud annually connecting outer edge portions of respective impeller blades is formed.

Accordingly, air supplied from an air supply port facing the hub of the centrifugal fan can be pressurized and sent toward the annular blowing path provided on the outer side in the radial direction by the impeller formed on the main plate.

The main plate continuing from the hub of the centrifugal fan on the outer side in the radial direction is formed in the dome shape; therefore, a space extending in the axial direction is formed inside the case body from the hub toward the outer side in the radial direction, as a result, the motor and tall components (electrolytic capacitor and the like) mounted to a motor board can be housed and the centrifugal fan can be assembled to the motor in a compact manner.

It is preferable that the motor is housed in an overlapping manner in a dome-shaped space formed by the hub of the centrifugal fan and the main plate continuing from the hub on an opposite surface side of the opening for air supply.

Accordingly, a dimension in the axial direction of the centrifugal blower can be reduced to thereby realize a small and flat blower even in the centrifugal blower in the same body type.

The centrifugal fan may be configured so that blades of a sub-impeller are each formed to stand on the main plate in the vicinity of the outer side in the radical direction between adjacent impeller blades.

Accordingly, the peak sound caused by pressure pulsation generated by the impeller can be effectively reduced without significantly reducing the blowing amount.

Advantageous Effects of Invention

According to the above-described centrifugal blower, high handleability and reliability can be obtained with the small and flat shape, the air volume and the static pressure can be secured, and noise reduction can be also realized.

DESCRIPTION OF EMBODIMENTS

First Embodiment

Hereinafter, an embodiment of a centrifugal blower according to the present invention will be explained with reference to the attached drawings. First, a schematic configuration of the centrifugal blower will be explained with reference to FIGS. 1A to 1C to FIGS. 3A and 3B. A DC blushless motor is used as a motor M, and an outer-rotor motor is used in the embodiment. An inner-rotor motor can be adopted.

Figure 1B:
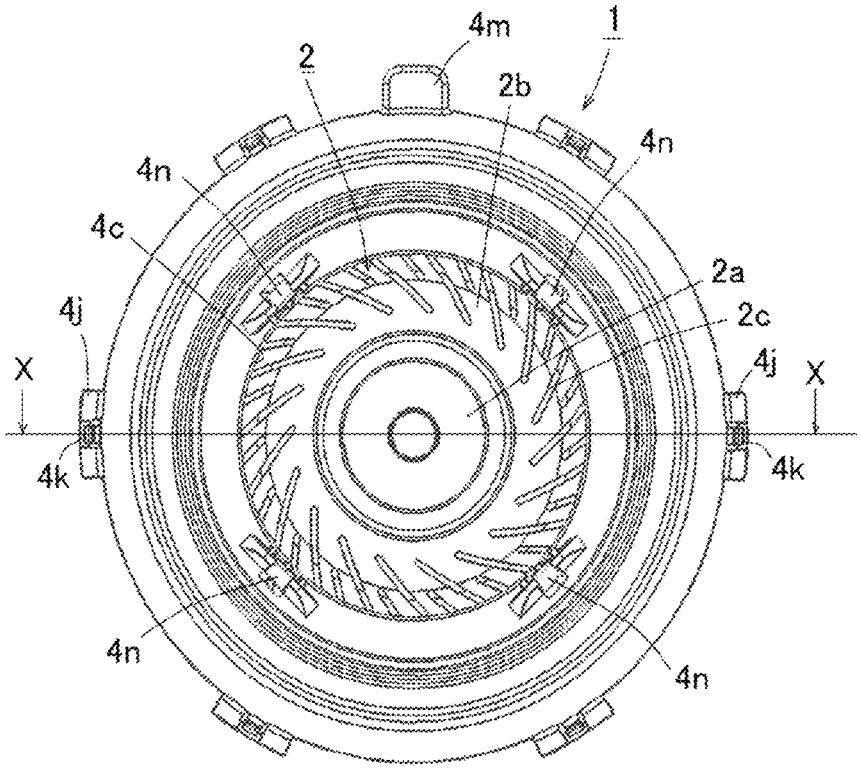
FIG. 1B is a plan view.
Figure 1A:
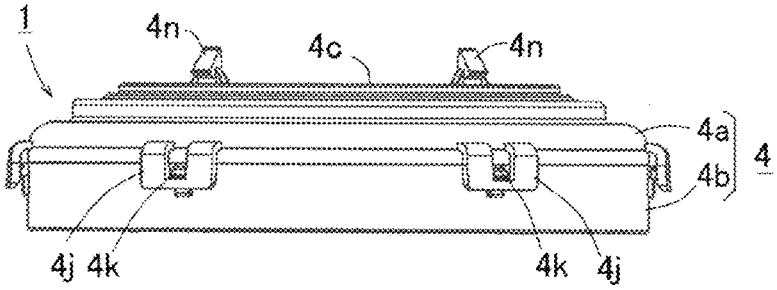
FIG. 1A is a front view of a centrifugal blower according to a first embodiment.
Figure 2B:
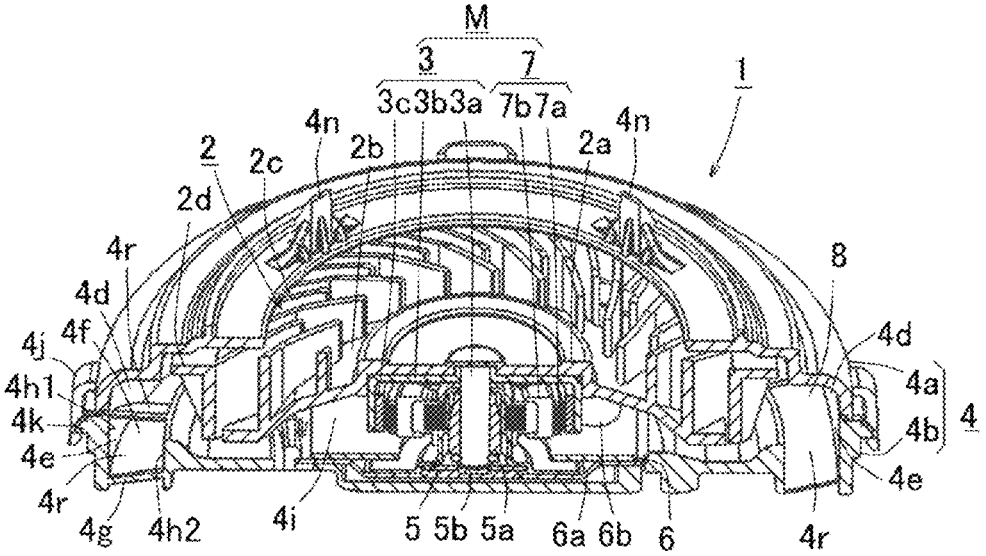
FIG. 2B is a sectional perspective view taken along the arrows X-X.
Figure 2A:
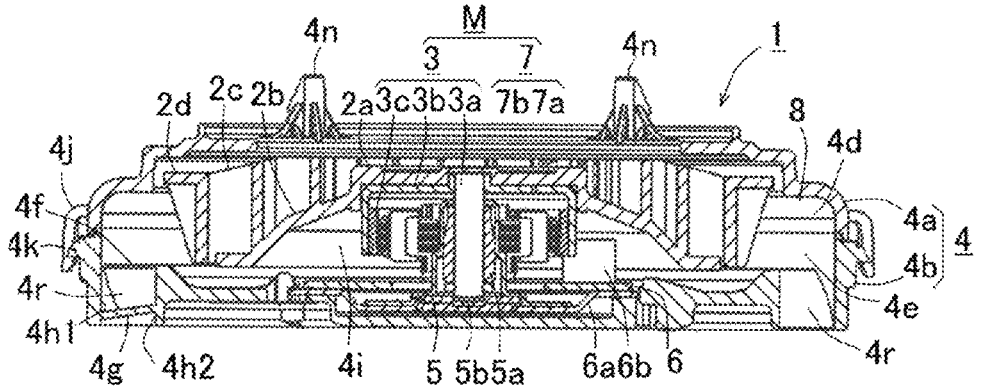
FIG. 2A is a sectional view taken along arrows X-X of the centrifugal blower of FIG. 1B.

As shown in FIGS. 2A and 2B, a centrifugal fan 2 and a rotor 3 (see FIGS. 3A and 3B) are integrally assembled in a centrifugal blower 1, and the motor M driving them to rotate is housed inside a case body 4. As shown in FIG. 1B, air is supplied from a central part in an axial direction of the case body 4, and the pressurized air is exhausted from an outer side in a radial direction along the axial direction. As shown in FIG. 1A, the case body 4 is formed by assembling a first case 4*a* assembled so as to cover the centrifugal fan 2 and a second case 4*b* rotatably supporting the motor M (the rotor 3 and a stator 7: see FIG. 2A).

In FIGS. 2A and 2B, an opening for air supply 4*c* is provided at a central part of the first case 4*a*, and a first blowing path 4*d* is formed on the outer side in the radial direction. In the second case 4*b*, a bearing holding portion 5 and a motor board 6 are assembled at a central part. Lead wires of stator coils 7*b* are connected to the motor board 6 and a hall sensor or the like detecting a position of a rotor magnet 3*c* is mounted. A position detection sensor may be omitted when the motor M belongs to a sensorless type. A stator core 7*a* is integrally fixed to an outer peripheral side of the bearing holding portion 5 and a rotor shaft 3*a* is rotatably supported at a shaft hole of the bearing holding portion 5 through a bearing 5*a*. The stator coils 7*b* are wound around pole teeth formed in the stator core 7*a*, and tip portions of the pole teeth are arranged to face the rotor magnet 3*c*. One end of the rotor shaft 3*a* is integrally assembled to a hub of a rotor yoke 3*b* formed in a cup shape by press fitting, shrink fitting, bonding, or combination thereof. The other end of the rotor shaft 3*a* is supported by a shaft support portion 5*b* provided inside the bearing holding portion 5. The shaft support portion 5*b* is supported by a board support portion 6*a* supporting the motor board 6. The rotor magnet 3*c* is integrally assembled to an inner peripheral surface of the rotor yoke 3*b*. The center of the opening for air supply 4*c* is not required to strictly correspond to an axis of the rotor shaft 3*a* of the motor M as long as the opening for air supply 4*c* is positioned in the vicinity of the central part in the axial direction of the case body 4 within a range in which the centrifugal fan 2 operates without losing efficiency.

As shown in FIGS. 2A and 2B, the centrifugal fan 2 is configured so that a main plate 2*b* continuing from a hub 2*a* to the outer side in the radial direction is formed in a dome shape. Air supplied from the opening for air supply 4*c* facing the hub 2*a* of the centrifugal fan 2 can be pressurized and sent toward an annular blowing path 8 provided on the outer side in the radial direction by an impeller 2*c* formed on the main plate 2*b*.

A dome-shaped space 4*i* is formed on an opposite surface side of the opening for air supply 4*c* by the hub 2*a* of the centrifugal fan 2 and the main plate 2*b* continuing to the hub 2*a* (see FIGS. 2A and 2B). The motor M and tall components (electrolytic capacitor 6*b* and the like) mounted on the motor board 6 can be housed by using the dome-shaped space 4*i*, and the centrifugal fan 2 can be assembled to the motor M in a compact manner. The rotor 3 and the stator 7 of the motor M are housed in the dome-shaped space 4*i* so as to overlap each other in the axial direction. Accordingly, a dimension in the axial direction of the centrifugal blower 1 can be reduced to thereby realize a small and flat blower even in the centrifugal blower 1 in the same body type.

Figure 2C:
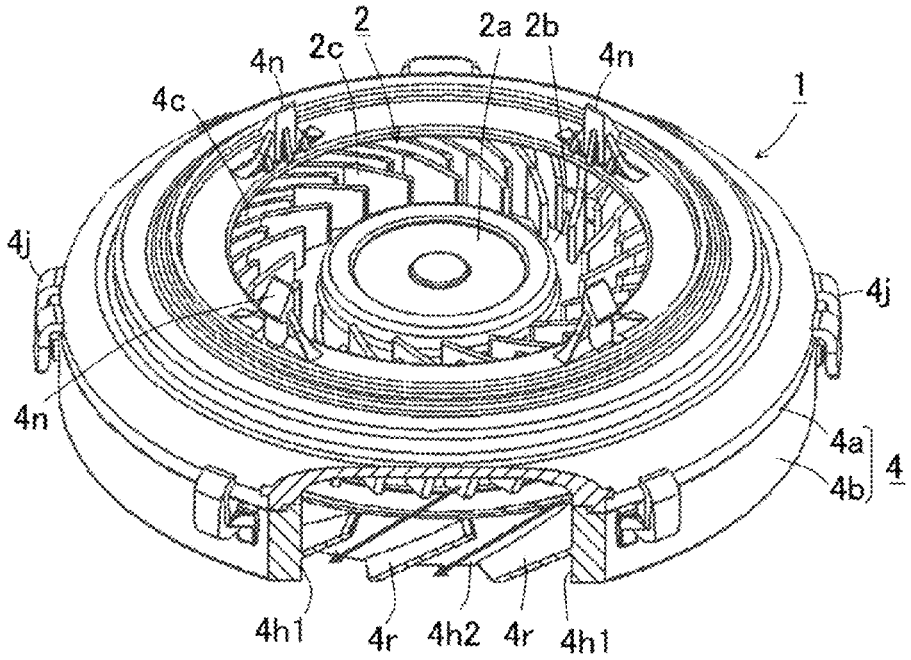
FIG. 2C is a partially cut perspective view of the centrifugal blower.
Figure 3A:
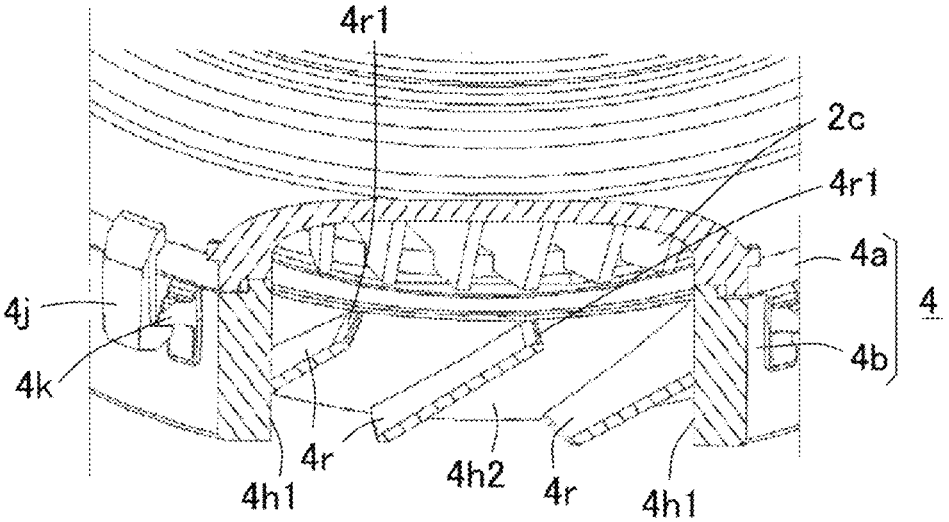
FIG. 3A is a partially cut enlarged perspective view of FIG. 2C.
Figure 3B:
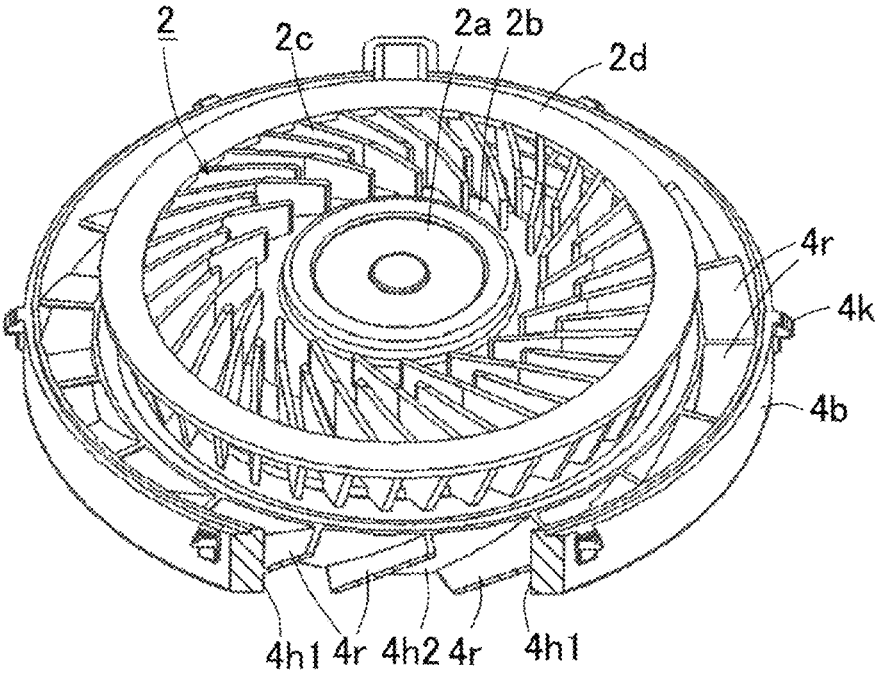
FIG. 3B is a partially cut perspective view in a state where a first case of FIG. 2C is removed.

A second blowing path 4*e* to be assembled with the first blowing path 4*d* is formed on the outer side in the radial direction of the second case 4*b*. The first case 4*a* and the second case 4*b* are assembled to form the annular blowing path 8 in an annular shape on the outer side in the radial direction of the case body 4. As shown in FIG. 2C and FIG. 3B, exhaust holes 4*f* exhausting pressurized compressed air along the axial direction are drilled at plural places in a circumferential direction on an outer peripheral side of a bottom portion of the second case 4*b* to be the second blowing path 4*e*. As shown in FIGS. 2A and 2B, the exhaust holes 4*f* are each formed in a manner in which the bottom portion of the second case 4*b* is partitioned by beams 4*g*. Respective beams 4*g* are disposed between a bottom outer peripheral wall 4*h*1 and a bottom inner peripheral wall 4*h*2. Moreover, a diffuser (diffuser plates 4*r*) for diffusing air exhausted from respective exhaust holes 4*f* is provided. The diffuser (diffuser plates 4*r*) exhausts air exhausted in the axial direction from the exhaust holes 4*f* provided in the second blowing path 4*e* toward a diagonally downward direction with respect to a rotating direction of the centrifugal fan 2 along slopes of respective diffuser plates 4*r* as shown by arrows in FIG. 2C.

Specifically, as shown in FIG. 2C, the diffuser plates 4*r* (see FIG. 1C, FIG. 3A) arranged so as to face respective exhaust holes 4*f* in a state of being inclined with respect to a direction crossing the rotating direction of the centrifugal fan 2 are formed integrally with the second case 4*b* at prescribed intervals. As shown in FIG. 3A, respective diffuser plates 4*r* are integrally formed at positions facing the exhaust holes 4*f* (see FIG. 1C) in a posture inclined diagonally downward between the bottom outer peripheral wall 4*h*1 and the bottom inner peripheral wall 4*h*2. The plural diffuser plates 4*r* are arranged so that the diffuser plates 4*r* adjacent in the circumferential direction do not overlap one another in plan view in the axial direction (see FIG. 2C, FIG. 3B).

As shown in FIG. 3A, when an upstream end portion 4*r*1 in the exhaust direction of the diffuser plate 4*r* forming the diffuser is chamfered to form an R-surface, resistance of airflow diffused by the diffuser plates 4*r* is reduced and the air can be exhausted smoothly.

Accordingly, the plural diffuser plates 4*r* adjacent to one another in the circumferential direction are arranged so as not to overlap one another in plan view in the axial direction; therefore, a required air volume can be secured even with the small and flat shape, and the static pressure can be increased even when an exhaust flow path from the centrifugal fan 2 to the exhaust hole 4*f* is short as compared with a case where the diffuser is not provided as described later. Moreover, the diffuser plates 4*r* can be integrally formed in the second case 4*b* easily with the exhaust holes 4*f*.

Figure 1C:
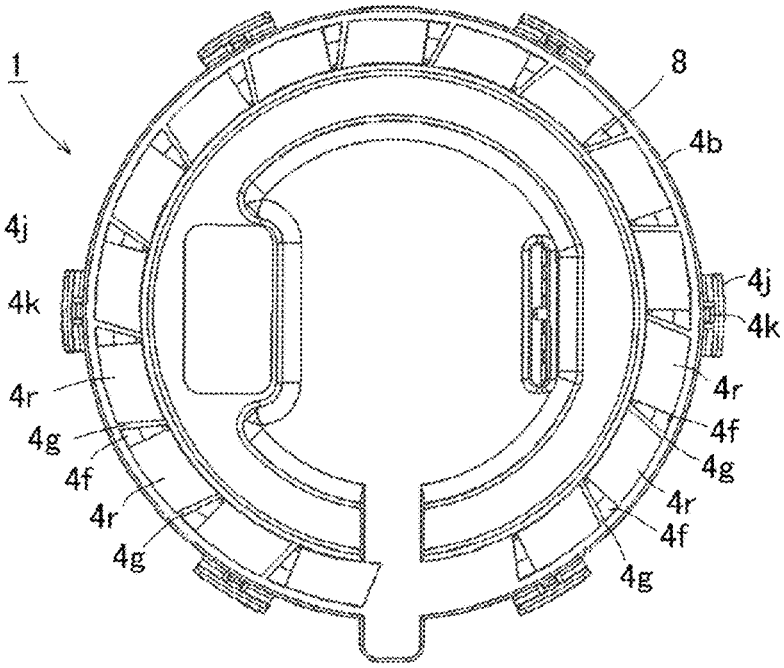
FIG. 1C is a bottom view.

As shown in FIGS. 1A to 1C, the first case 4*a* and the second case 4*b* are integrally assembled by locking pieces 4*j* provided on an outer periphery of a side part of the first case 4*a* being locked to locking portions 4*k* provided on an outer periphery of a side part of the second case 4*b*. A wiring connection port 4*m* taking the wiring connected to the motor board 6 out of the case is formed in the first case 4*a* and the second case 4*b*. Hooks 4*n* for attaching to an on-vehicle seat are provided at a peripheral edge of the opening for air supply 4*c* of the first case 4*a*.

According to the above configuration, the case body 4 housing the centrifugal fan 2 and the motor M driving the fan to rotate is formed by combining the first case 4*a* in which the opening for air supply 4*c* is provided at the central part and the first blowing path 4*d* is formed on the outer side in the radial direction and the second case 4*b* rotatably supporting the motor M, in which the second blowing path 4*e* to be combined with the first blowing path 4*d* is formed on the outer side in the radial direction; therefore, the rigidity of the case body 4 is high and the handleability is good at the time of assembling. Moreover, a partitioning wall called a tongue part does not exist in the annular blowing path 8 formed around the outer side in the radial direction of the case body 4; therefore, peak sound is not generated and noise reduction can be realized.

The plural exhaust holes 4*f* exhausting the compressed air to the outside of the case body 4 are drilled in the second blowing path 4*e* in the annular blowing path 8 in the circumferential direction at prescribed intervals; therefore, the side surface of the case body 4 can be closed to thereby improve strength of the case body 4. Moreover, the compressed air sent to the annular blowing path 8 can be efficiently exhausted by the exhaust holes 4*f* drilled in the circumferential direction at plural places, as a result, a required air volume can be secured even with the small and flat shape. Furthermore, the diffuser (diffuser plates 4*r*) for diffusing the compressed air exhausted from the respective exhaust holes 4*f* is provided; therefore, the static pressure can be increased even when the exhaust flow path from the centrifugal fan 2 to the exhaust hole 4*f* is short, and the air volume can be secured even when a load is generated.

FIG. 3B is a perspective view of the centrifugal fan 2 (turbofan). In FIG. 3B, the centrifugal fan 2 includes the hub 2*a* assembled integrally with the rotor yoke 3*b* at the central part. The centrifugal fan 2 is insert-molded with the rotor yoke 3*b* so that an upper surface portion of the rotor yoke 3*b* is integrated with the hub 2*a* (see FIGS. 2A and 2B). The main plate 2*b* continuing to the hub 2*a* is extended to be inclined to a downstream side in a blowing direction toward the outer side in the radial direction, and a plurality of curved blades of the impeller 2*c* are formed to stand on the main plate 2*b* from an inner side to the outer side in the radial direction. An annular shroud 2*d* is formed at an edge on the outer peripheral side of the impeller 2*c*, which rectifies air continuously sucked to an inner bottom surface of the first case 4*a* (see FIG. 2A) and sends the air.

According to the above configuration, the plural exhaust holes 4*f* for exhausting compressed air out of the case body 4 are drilled on the bottom portion of the second blowing path 4*e* in the circumferential direction at prescribed intervals; therefore, the side surface of the case 4 can be closed to thereby improve strength of the case body 4. The compressed air sent to the annular blowing path 8 can be efficiently exhausted by the exhaust holes 4*f* drilled in the circumferential direction at plural places, as a result, a required air volume can be secured even with the small and flat shape. Furthermore, the diffuser (diffuser plates 4*r*) for diffusing air exhausted from respective exhaust holes 4*f* in the axial direction is provided; therefore, the static pressure can be increased even when the exhaust flow path from the centrifugal fan 2 to the exhaust hole 4*f* is short as compared with a case where the diffuser is not provided.

The plural diffuser plates 4*r* are arranged so that the diffuser plates 4*r* adjacent in the circumferential direction do not overlap one another in plan view in the axial direction; therefore, the diffuser plates 4*r* can be integrally formed in the second case 4*b* easily with the exhaust holes 4*f*.

Here, characteristics of the embodiment will be complemented.

In FIG. 1C, FIG. 2C, FIGS. 3A and 3B, a line (upstream end line) connecting ends of the upstream end portion 4*r*1 in the exhaust direction of one diffuser plate 4*r* in the plural diffuser plates 4*r* forming the diffuser crosses the center of a rotation axis of the centrifugal fan 2 in plan view in the axial direction. That is, the line corresponds to a line extending from the center of the rotation axis of the centrifugal fan 2 to an outer peripheral direction (radial direction) in plan view in the axial direction. On the other hand, a line (downstream end line) connecting ends of a downstream end portion in the exhaust direction which is the end portion on the opposite side of the upstream end portion 4*r*1 in the exhaust direction of the diffuser plate 4*r* is parallel to the upstream end line in plan view in the axial direction and does not cross the center of the rotation axis of the centrifugal fan 2. That is, the diffuser plate 4*r* does not form an acute-angle sector form lacking a central portion in plan view from the axial direction. This means that a distance from the upstream end portion in the exhaust direction of the diffuser plate 4*r* to the downstream end portion in the exhaust direction on a circumference centered at the rotation axis of the centrifugal fan 2 on the bottom outer peripheral wall 4*h*1 side is approximately equivalent to that on the bottom inner peripheral wall 4*h*2 side because the centrifugal fan according to the embodiment is flat, the exhaust holes are arranged in the bottom portion on the outer peripheral side, and a width of the exhaust holes in the radial direction is smaller than a distance from the center of the rotation axis of the centrifugal fan 2. Accordingly, the pressurized compressed air flowing on the surface of the diffuser plates 4*r* is exposed to surface air resistance with approximately equivalent distances with respect to the diffuser plates 4*r* both on the bottom outer peripheral wall 4*h*1 side and on the bottom inner peripheral wall 4*h*2 side; therefore, there are advantages such that generation of turbulence at the downstream ends is suppressed.

As shown by a bottom view of FIG. 1C, the diffuser plates 4*r* adjacent to one another in the circumferential direction are arranged so as not to overlap one another in plan view in the axial direction, and the upstream end line of one diffuser plate 4*r* and the downstream end line of the adjacent diffuser plate 4*r* make a fixed angle in plan view in the axial direction, and a clearance in which the bottom outer peripheral wall 4*h*1 side is larger than the bottom inner peripheral wall 4*h*2 side is formed. In the annular blowing path 8 according to the embodiment, a density distribution of the air flow rate is biased so that the outer peripheral side becomes high due to the action of a centrifugal force. Accordingly, the clearance in which the outer peripheral side is larger is formed, thereby exhausting air smoothly.

In FIGS. 1A to 1C to FIGS. 3A and 3B, the downstream end portions of the diffuser plates 4*r* in the exhaust direction are places where the diffuser plates 4*r* are exposed to the bottom surface side, which correspond to the beams 4*g* themselves. That is, the beam 4*g* is part of the diffuser plate 4*r* as the downstream end portion of the diffuser plate 4*r* in the exhaust direction. However, in a case where the diffuser plates 4*r* are formed to be extremely thin for reducing noise or increasing the flow path as a modification example of the embodiment, it is also possible to form the diffuser plates 4*r* and the beams 4*g* so as not to be integrated but as separate members for reinforcing the rigidity of the case body 4.

Although the thickness of the diffuser plates 4*r* is fixed in FIGS. 1A to 1C to FIGS. 3A and 3B, the diffuser plate is not limited to this. The thickness of the upstream end portion's side in the exhaust direction may be different from that of the downstream end portion's side in the exhaust direction. For example, the upstream end portion's side in the exhaust direction may be thin and the downstream end portion's side in the exhaust direction may be thick.

Second Embodiment

Next, a second embodiment of the centrifugal blower 1 will be explained with reference to FIG. 4 to FIG. 6. The same numerals are given to the same members as those of the centrifugal blower 1 according to the first embodiment and the explanations thereof are applied. In the following description, different configurations relating to the state of the diffuser provided in the second case 4*b* will be chiefly explained.

Figure 4:
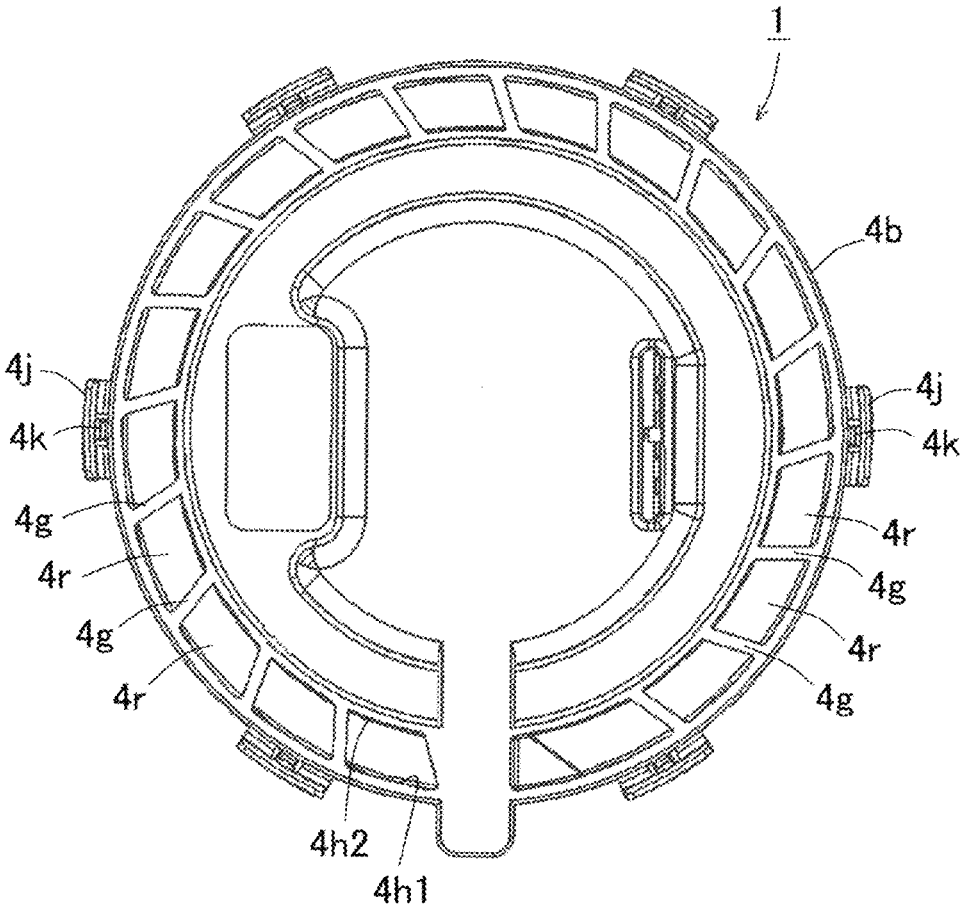
FIG. 4 is a bottom view of a centrifugal blower according to a second embodiment.

As shown in FIG. 4, the exhaust holes 4*f* are each formed in the manner in which the bottom portion of the second case 4*b* is partitioned by beams 4*g*.

The respective beams 4*g* are disposed between the bottom outer peripheral wall 4*h*1 and the bottom inner peripheral wall 4*h*2. Moreover, the diffuser (diffuser plates 4*r*) for diffusing air exhausted from respective exhaust holes 4*f* is provided in the second case 4*b*.

Figure 5B:
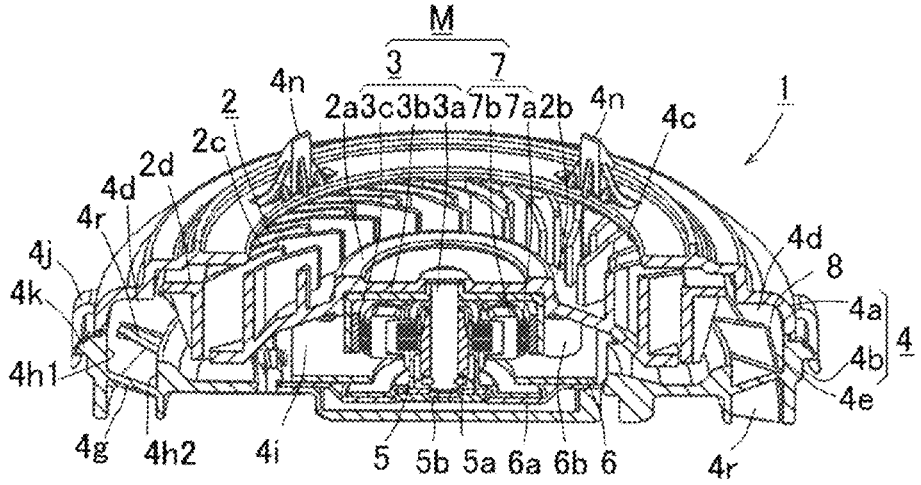
FIG. 5B is a sectional perspective view in the axial direction.
Figure 5A:
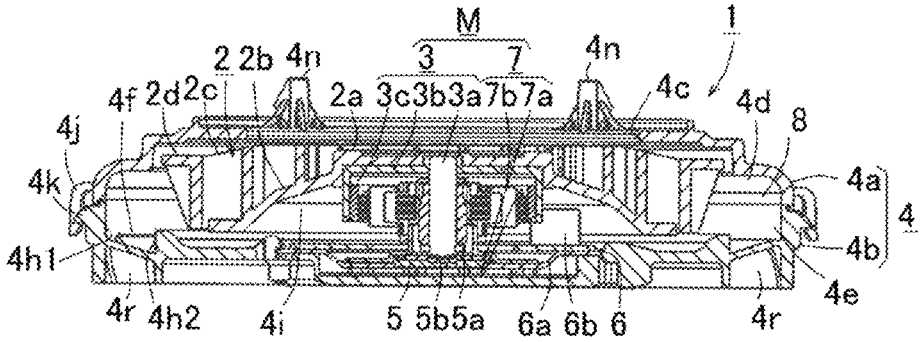
FIG. 5A is a sectional view in an axial direction of the centrifugal blower of FIG. 4.
Figure 5C:
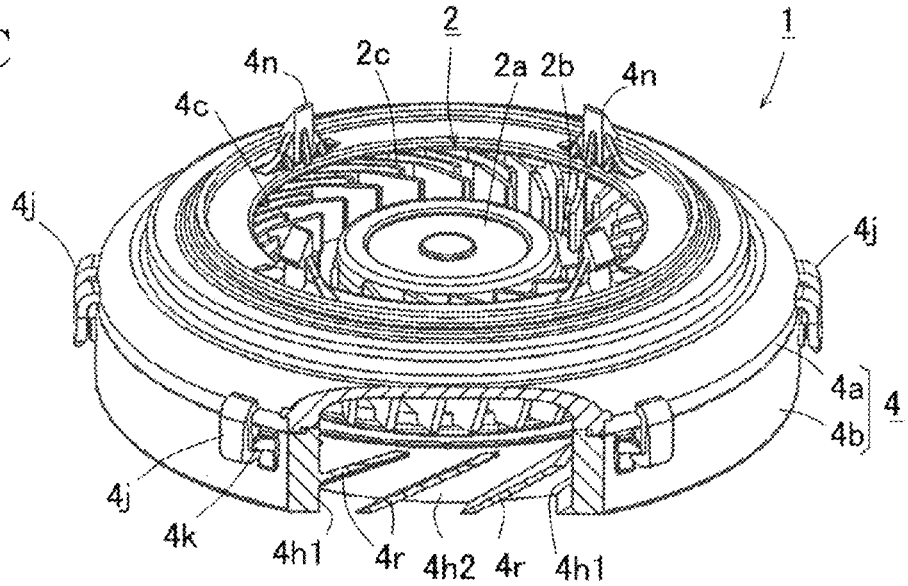
FIG. 5C is a partially cut perspective view of the centrifugal blower.

As shown in FIG. 5C, the plural diffuser plates 4*r* are arranged to face respective exhaust holes 4*f* in the state of being inclined to a direction crossing the rotating direction of the centrifugal fan 2. The respective diffuser plates 4*r* are integrally formed at positions facing the exhaust holes 4*f* (see FIG. 4) in a posture inclined diagonally downward between the bottom outer peripheral wall 4*h*1 and the bottom inner peripheral wall 4*h*2. The plural diffuser plates 4*r* are arranged so that the diffuser plates 4*r* adjacent in the circumferential direction overlap one another in plan view in the axial direction. When upstream end portions 4*r*1 in the exhaust direction of respective diffuser plates 4*r* forming the diffuser are chamfered to form R-surfaces, resistance of airflow diffused by the diffuser plates 4*r* is reduced and the air can be exhausted smoothly. The diffuser (diffuser plates 4*r*) exhausts air exhausted in the axial direction from the exhaust holes 4*f* provided in the second blowing path 4*e* toward the diagonally downward direction with respect to the rotating direction of the centrifugal fan 2 along slopes of the diffuser plates 4*r* as shown in FIG. 5C.

The plural diffuser plates 4*r* are arranged so that the diffuser plates 4*r* adjacent to one another in the circumferential direction overlap one another in plan view in the axial direction as described above; therefore, the required air volume can be secured even with the small and flat shape although an advanced molding technique is required, and the static pressure can be increased more even when the exhaust flow path from the centrifugal fan 2 to the exhaust hole 4*f* is short as compared with the case where the diffuser is not provided in the exhaust hole 4*f* as described later.

Figure 6:
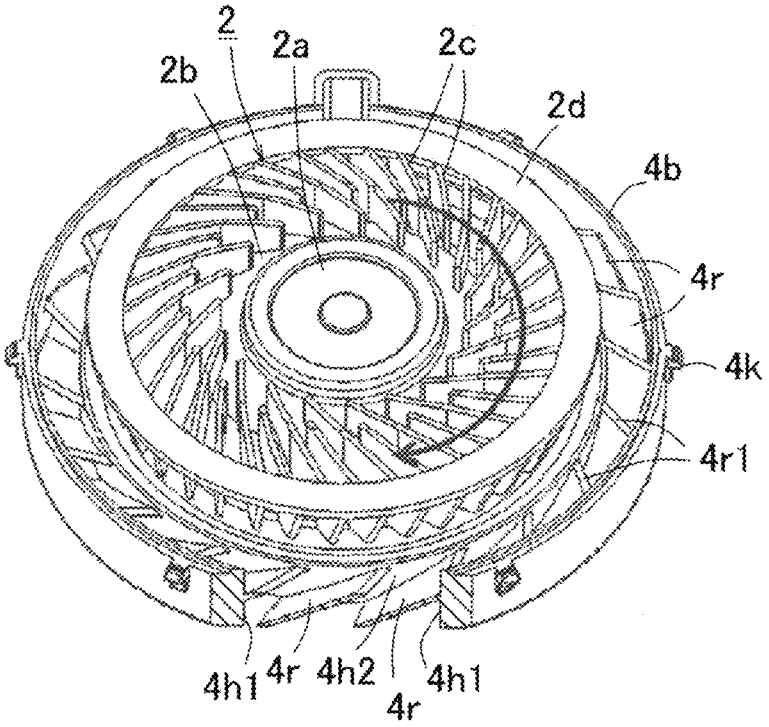
FIG. 6 is a partially cut perspective view and a partially cut enlarged view in a state where the first case of FIG. 5C is removed.

As shown in FIG. 6, the plural diffuser plates 4*r* forming the diffuser may have a skew shape in which the diffuser plates 4*r* are shifted in the rotating direction of the centrifugal fan 2 with respect to the radial direction by a prescribed amount so that air is exhausted following the rotation of the centrifugal fan 2 in an arrow direction. For example, the diffuser may be formed in the skew shape in which a line connecting points at the same heights in the axial direction on a cross section of the diffuser plates 4*r* in the radial direction is skewed with respect to the radial direction. When the diffuser plates 4*r* are regarded as slopes formed by enveloping nosings (corners) of respective stairs of a spiral staircase with a minute step, the nosings of respective stairs correspond to "the line connecting points at the same heights in the axial direction". When the line which corresponds to the nosings is represented as a contour line, the contour line corresponds to a direction (radial direction) from the center of the rotation axis of the centrifugal fan 2 toward the outer periphery in the diffuser plate 4*r* in FIG. 1C (first embodiment); however, the contour line does not correspond to that direction in the diffuser plate 4*r* in FIG. 6, which is shifted in the rotating direction of the centrifugal fan 2 with respect to a segment in the radial direction by a prescribed angle. Specifically, the direction of the contour line deflects in the rotating direction of the centrifugal fan 2 with respect to the outer peripheral side in the radial direction.

When respective diffuser plates 4*r* are formed in the skew shape in which the diffuser plates 4*r* are shifted in the rotating direction of the centrifugal fan 2 by the prescribed amount with respect to the radial direction, air exhausted from respective exhaust holes 4*f* in the axial direction can be diffused along the rotating direction of the centrifugal fan 2, places where the peak sound with frequency components calculated by multiplying the number of blades of the impeller 2*c* by a rotation frequency is generated can be diffused to thereby reduce noise.

The direction of the above contour line that characterizes the shape of the diffuser plates 4*r* may deflect in an opposite direction of the rotating direction of the centrifugal fan 2 on the outer peripheral side with respect to the segment in the radial direction. The contour line is not only a straight line but also a curved line. The upstream end portions in the exhaust direction and the downstream end portions in the exhaust direction of the diffuser plate 4*r* are parallel to the contour line in the drawing. It is not always necessary that the upstream end portion in the exhaust direction and the downstream end portion in the exhaust direction are at the same height in the axial direction as long as they are parallel to each other in plan view in the axial direction.

Here, characteristics of the embodiment will be complemented.

In FIG. 4, FIG. 5C, and FIG. 6, a line (upstream end line) connecting ends of the upstream end portion 4*r*1 in the exhaust direction of one diffuser plate 4*r* in the plural diffuser plates 4*r* forming the diffuser is skewed as described above, which differs from the first embodiment; therefore, the line does not cross the center of the rotation axis of the centrifugal fan 2 in plan view in the axial direction. On the other hand, the line (downstream end line) connecting ends of the downstream end portion in the exhaust direction which is the end portion on the opposite side of the upstream end portion 4*r*1 in the exhaust direction of the diffuser plate 4*r* is parallel to the upstream end line in plan view in the axial direction. This means that similarly to the first embodiment, the distance from the upstream end portion in the exhaust direction of the diffuser plate 4*r* to the downstream end portions in the exhaust direction on the circumference centered at the rotation axis of the centrifugal fan 2 on the bottom outer peripheral wall 4*h*1 side is approximately equivalent to that on the bottom inner peripheral wall 4*h*2 side because the centrifugal fan according to the embodiment is flat, the exhaust holes are arranged in the bottom portion on the outer peripheral side, and a width of the exhaust holes in the radial direction is smaller than a distance from the center of the rotation axis of the centrifugal fan 2. Accordingly, the pressurized compressed air flowing on the surface of the diffuser plates 4*r* is exposed to surface air resistance with approximately equivalent distances with respect to the diffuser plates 4*r* both on the bottom outer peripheral wall 4*h*1 side and on the bottom inner peripheral wall 4*h*2 side; therefore, there are advantages such that generation of turbulence at the downstream ends in the exhaust direction is suppressed.

As shown in FIG. 4 to FIG. 6, the diffuser plates 4*r* adjacent to one another in the circumferential direction are arranged so as to overlap one another in plan view in the axial direction. The downstream end line of a certain diffuser plate 4*r* and the upstream end line of the adjacent diffuser plate 4*r* make a fixed angle in plan view in the axial direction. When the diffuser plate 4*r* according to the embodiment is compared with "the diffuser plate having an acute-angle sector form lacking the central portion" or "the diffuser plate in which portions corresponding to the upstream end line and the downstream end line according to the present invention are skewed based on the acute-angle sector form lacking the central portion" in plan view in the axial direction, a distance in which the diffuser plate 4*r* according to the embodiment contacts the bottom outer peripheral wall 4*h*1 becomes shorter as compared with these diffuser plates with the sector form. This is because the relative relationship between the upstream end line and the downstream end line of one diffuser plate 4*r* according to the present invention is parallel, not a radial shape centered at the same point as described above. Accordingly, a cross section of the flow path becomes wider on the outer peripheral side in the vicinity of the downstream end portion (beam 4*g*) in the exhaust direction than in the vicinity of the upstream end portion 4*r*1 in the exhaust direction of the diffuser plate 4*r*. In the annular blowing path 8 according to the embodiment, the density distribution of the air flow rate is biased so that the outer peripheral side becomes high due to the action of the centrifugal force. Accordingly, the cross section of the flow path on the outer peripheral side is increased, thereby exhausting air smoothly.

In FIG. 4 to FIG. 6, the downstream end portions of the diffuser plates 4*r* in the exhaust direction are places where the diffuser plates 4*r* are exposed to the bottom surface side, which correspond to the beams 4*g* themselves. That is, the beam 4*g* is part of the diffuser plate 4*r* as the downstream end portion of the diffuser plate 4*r* in the exhaust direction. However, in the case where the diffuser plates 4*r* are formed to be extremely thin for reducing noise or increasing the flow path as a modification example of the embodiment, it is also possible to form the diffuser plates 4*r* and the beams 4*g* so as not to be integrated but as separate members for reinforcing the rigidity of the case body 4.

Although the thickness of the diffuser plates 4*r* is fixed in FIG. 4 to FIG. 6, the diffuser plate is not limited to this. The thickness of the upstream end portion's side in the exhaust direction may be different from that of the downstream end portion's side in the exhaust direction. For example, the upstream end portion's side in the exhaust direction may be thin and the downstream end portion's side in the exhaust direction may be thick.

Figure 9:
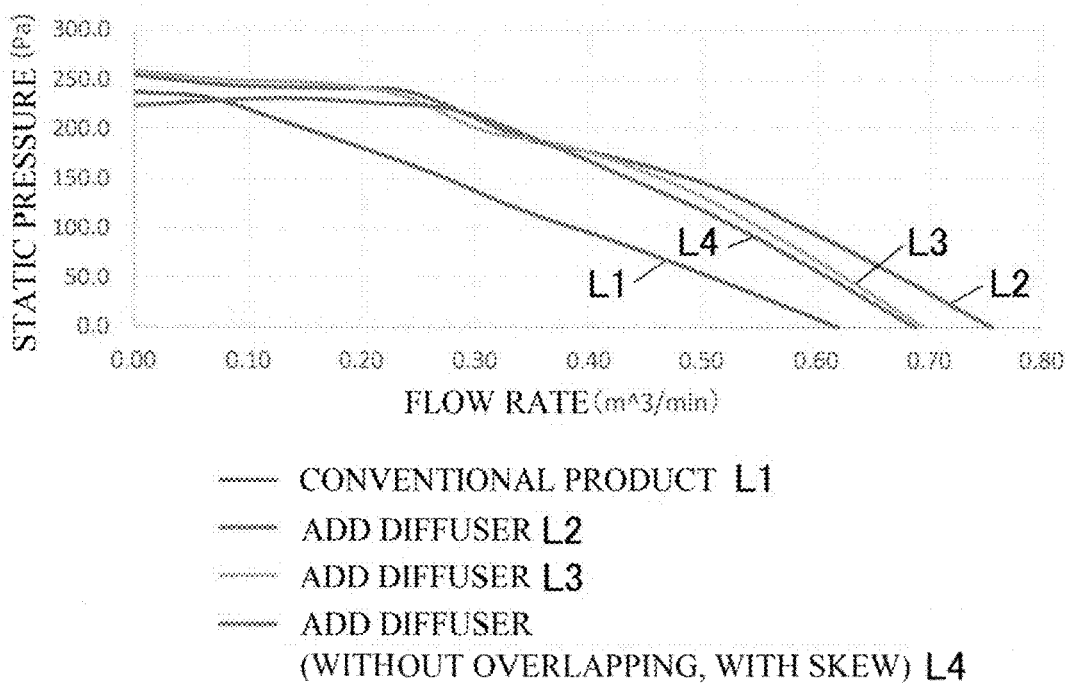
FIG. 9 is a graph showing characteristics between the flow rate and the static pressure according to the existence of a diffuser of the centrifugal blower.

Here, characteristics between the flow rate and the static pressure according to the existence of the diffuser in the exhaust holes 4*f* of the second case 4*b* and the arrangement state of the diffuser plates 4*r* are shown in a graph of FIG. 9.

A graph line L1 shows characteristics between the static pressure and the flow rate (P-Q characteristics) in a case where the diffuser is not provided in the exhaust holes 4*f*. A graph line L2 shows the static pressure and the flow rate (P-Q characteristics) in a state where the diffuser is provided in the exhaust holes 4*f* shown in FIG. 2C (the arrangement in which the diffuser plates 4*r* do not overlap one another in plan view). A graph line L3 shows the static pressure and the flow rate (P-Q characteristics) in a state where the diffuser is provided in the exhaust holes 4*f* shown in FIG. 6 (arrangement in which the diffuser plates 4*r* overlap one another in plan view). A graph line L4 shows the static pressure and the flow rate (P-Q characteristics) in a state where the diffuser is provided in the exhaust holes 4*f* shown in FIG. 6 so that the diffuser plates 4*r* do not overlap one another in plan view (not shown). As can be seen, the static pressure is improved in the case where the diffuser is provided in the exhaust holes 4*f* (L2, L3, and L4) as compared with the case in which the diffuser is not provided (L1) even in the same flow rate as shown by an arrow. Accordingly, the static pressure can be increased by providing the diffuser even when the exhaust flow path from the centrifugal fan 2 to the exhaust hole 4*f* is short.

Figure 7A:
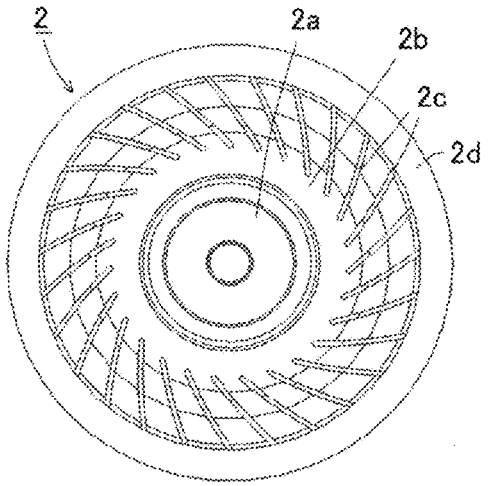
FIGS. 7A to 7F are plan views and a perspective view showing various states of centrifugal fans.
Figure 7B:
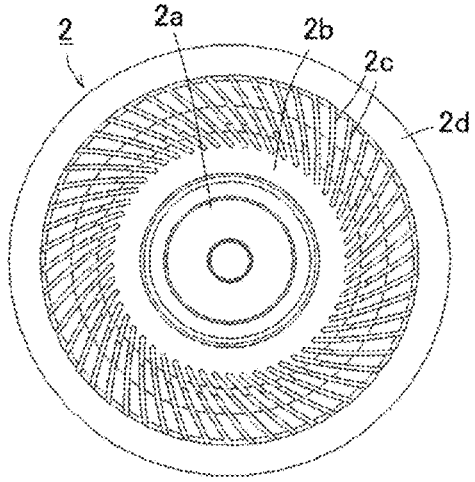

As shown in FIG. 7A, a normal turbofan is formed so that outer peripheral ends of the impeller 2*c* formed to stand on the main plate 2*b* curve to protrude backward in the rotating direction. As the number (of blades) of the impeller 2*c* is smaller and intervals of the blades are wider than that of a sirocco fan or the like, pressure pulsation of each blade is increased. The pressure pulsation of each blade may interfere with the diffuser to generate the peak sound. In order to diffuse a spectrum of the peak sound, it can be considered that the number (of blades) of the impeller 2*c* is increased as shown in the centrifugal fan 2 of FIG. 7B. However, when an air flow path is narrowed on an inner side in the radial direction of the impeller 2*c*, fan characteristics (a blowing amount) are reduced. Moreover, the wall thickness of the impeller 2*c* integrally formed on the main plate 2*b* is reduced, which increases costs for manufacturing a mold and increases manufacturing costs.

Figure 7C:
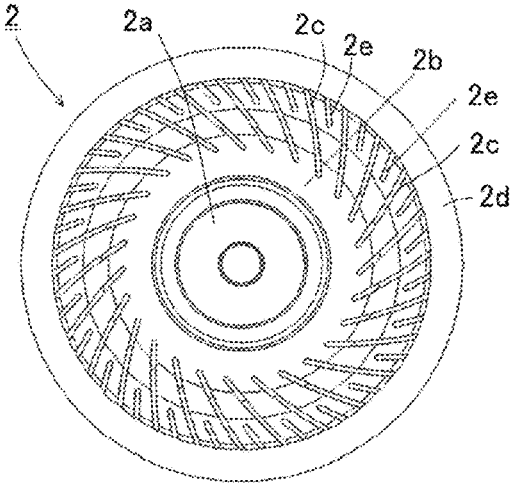
Figure 7D:
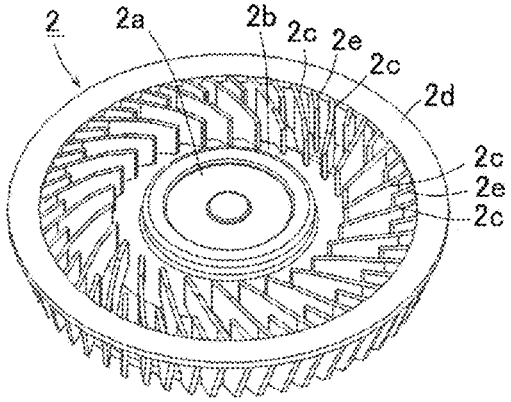

Accordingly, other examples of the centrifugal fan 2 in which the reduction in fan characteristics and the increase of manufacturing costs are suppressed are shown in FIG. 7C to 7F. FIG. 7D is a perspective view of FIG. 7C. As shown in FIGS. 7C and 7D, blades of a sub-impeller 2*e* are formed to respectively stand in the vicinity of the outer side in the radial direction (outer peripheral edge) of blades of the impeller 2*c* formed to stand on the main plate 2*b* continued from the hub 2*a* at equal intervals from adjacent blades of the impeller 2*c* (central parts between blades of the impeller 2*c*). Accordingly, the pressure pulsation of each blade is reduced to thereby suppress generation of the peak sound caused by the interference with the diffuser. The wall thicknesses of the impeller 2*c* and the sub-impeller 2*e* are not required to be changed or are required to be slightly changed; therefore, the increase in manufacturing costs can be suppressed.

Figure 7E:
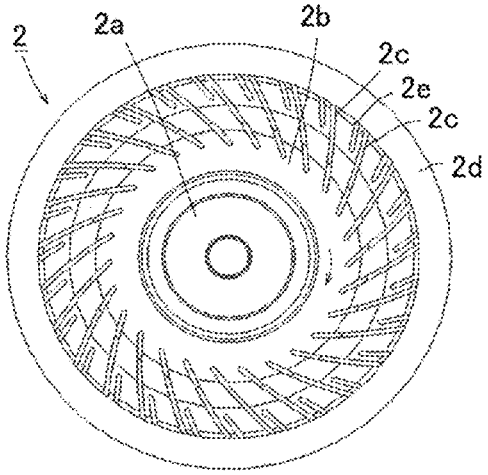
Figure 7F:
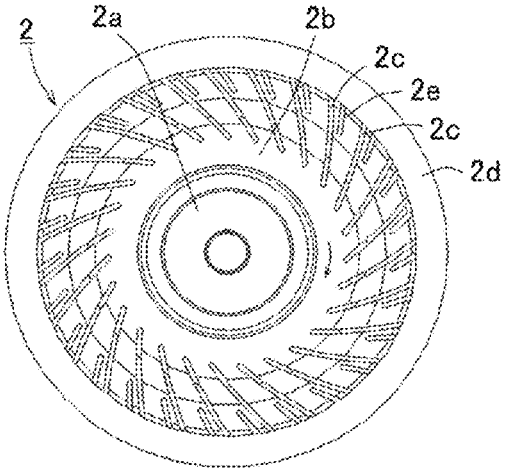
Figure 8:
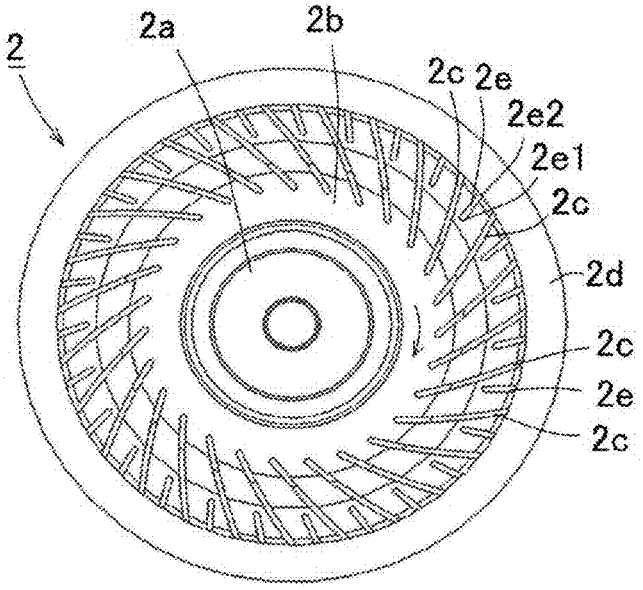
FIG. 8 is a plan view showing a state of the centrifugal fan continued from FIG. 7.

The centrifugal fans 2 shown in FIGS. 7E, 7F and FIG. 8 are modification examples of FIGS. 7C and 7D. Specifically, blades of the sub-impeller 2*e* formed to stand between blades of the impeller 2*c* on the main plate 2*b* are not required to be provided at equal intervals from adjacent blades of the impeller 2*c* (central parts between blades of the impeller 2*c*). For example, blades of the sub-impeller 2*e* may be formed to stand closer to forward blades of the impeller 2*c* in the rotating direction as shown in FIG. 7E, or blades of the sub-impeller 2*e* may be formed to stand closer to backward blades of the impeller 2*c* in the rotating direction as shown in FIG. 7F.

Furthermore, as shown in FIG. 8, inner end positions in the radial direction of blades of the sub-impeller 2*e* provided between blades of the impeller 2*c* may be formed in an imbalanced manner with respect to an outer end position in the radial direction. That is, an inner end position 2*e*1 in the radial direction of the blade of the sub-impeller 2*e* may be positioned close to a backward blade of the impeller 2*c* in the rotating direction and an outer end position 2*e*2 in the radial direction of the blade may be positioned at the center between blades of the impeller 2*c*. That is, wide and narrow intervals may be formed in an upstream passage (on the inner side in the radial direction) for compressed air passing between blades of the impeller 2*c* and intervals in a downstream passage (on the outer side in the radial direction) becomes equal.

Here, advantages of the centrifugal blower 1 according to the present invention in vehicle air conditioning will be explained in detail.

In the case where the centrifugal blower 1 according to the embodiment is mounted to a vehicle seat for the purpose of suction-type seat air conditioning, the rate of noise generated in the following process is high as compared with noise of the entire seat air conditioning, the process, which is included in the operation of the centrifugal blower, according to the present invention, is: "air is supplied from the axial direction by rotation of the centrifugal fan 2, the airflow is generated inside the case body 4 in the outer peripheral direction, the direction is changed in the vicinity of the outer periphery in the case body 4, and the air is exhausted to an opposite direction to the suction direction at the outer peripheral part". The flow path from the suction port on the seat surface to the centrifugal blower 1 according to the present invention is short, and a sufficient cross-sectional area of the flow path with respect to an exhaust flow rate can be secured at the exhaust port of the centrifugal blower 1 according to the present invention; therefore, factors of noise generation other than the blower are limited. Therefore, noise of components other than the blower and noise of the centrifugal blower 1 according to the present invention can be clearly separated. As noise generation factors and characteristics such as output of the centrifugal blower 1 according to the present invention are confined inside the case body 4, characteristics (output and noise) as the blower are stable. The rigidity of the case body 4 is high as described above; therefore, the degree of freedom in position and shape of a mounting place of the seat to which the centrifugal blower 1 according to the present invention is mounted is increased and one shape of the blower can be applied to various types of seat, which realizes cost reduction due to effects of mass production.

Moreover, simulate accuracy in seat air conditioning characteristics relating to occupant's comfortability in riding is increased from the design stage of the vehicle as characteristics (output and noise) become stable; therefore, secondary effects that design man-hours in a vehicle manufacturer is reduced can be obtained.

Furthermore, when comparing with the suction-type seat air conditioning disclosed in the above related-art document (Patent Literature 1: JP-A-2015-174580), there is an advantage that the seat can be reduced in size by adopting the centrifugal blower 1 according to the present invention.

In the blower disclosed in Patent Literature 1, air is exhausted toward the radial direction (outer peripheral side) of the rotation axis, which is different from the present invention. Accordingly, there is a concern about durability with respect to mechanical stress of the blower as described above, and mechanically strong design is required, as a result, dimensions and weight are increased. Additionally, it is necessary to provide a connecting part to a duct inside the seat or a seat-back rear side exhaust port in the blower for processing the exhausted air at a seat rear-end part (the rear end part in a case of a back surface, a lower end part in the case of a seat surface); therefore, the dimensions and weight are further increased. In response to this, it is possible to exhaust air from the seat-back rear side directly through the seat surface in the centrifugal blower 1 according to the present invention; therefore, high rigidity can be obtained and size reduction can be realized by omitting accompanying items as compared with the centrifugal blower according to Patent Literature 1.

A component such as the blower for air-conditioning in the vehicle seat has not existed in the past, and the seat to which the blower is mounted is actually regarded as an existence of a foreign substance in a seat cushion. In order to prevent a seated occupant from feeling the blower to be the foreign substance, it is necessary to reduce the blower in size or to increase the thickness of the seat cushion. Considering the recent trend of reduction in weight and size of the vehicle, it is obvious that the centrifugal blower 1 according to the present invention has advantages following the trend.

The above embodiments have been explained by citing the on-vehicle seat air conditioning as the example; however, there is no limitation thereto and the embodiments may be applied to a centrifugal blower for HVAC (Heating, Ventilation, and Air Conditioning) and the like. For example, the centrifugal blower 1 according to the present invention can be applied to the HVAC for vehicles other than seat air conditioning. The blower for air conditioning (blower with a scroll-casing having a tongue part) has been arranged in a surplus space in a car in the past; however, the surplus space is reduced due to size reduction and enlargement of an occupation space of the car in recent years, and a vehicle body structure of an electric car differs from those of conventional cars; therefore, the study of a space for arranging the blower for air conditioning is becoming an issue bothering a car designer. When the blower having characteristics of thin, high pressure, and the same direction of suction and exhaust like the centrifugal blower 1 according to the present invention is applied, the degree of freedom in design of the car can be improved. The HVAC-related devices are concentratedly arranged in the vicinity of a front seat under knees in related-art vehicles due to the relation of an installation position of the blower; however, a plurality of blowers can be arranged at a ceiling, a side wall, a door, and the like in a decentralized manner when adopting the centrifugal blower 1 according to the present invention. Decentralized air conditioning with saved space can be realized by combining the blower with a thermoelectric device such as a Peltier device, which may be helpful to car design with high space utilization efficiency. It goes without saying that the present invention has the similar advantages even in places other than vehicles, where the surplus space is small and where it is difficult to secure a space for arranging the conventional blower for air conditioning.

What is claimed is:

1. A centrifugal blower in which a centrifugal fan and a motor driving the centrifugal fan to rotate are housed in a case body, air is supplied from a central part in an axial direction of the case body, and compressed air is exhausted from a plurality of exhaust holes provided at a bottom portion on an outer side in a radial direction of the case body, wherein the case body includes a first case assembled so as to cover the centrifugal fan, in which an opening for air supply is provided at a central part and a first blowing path is formed on the outer side in the radial direction, and a second case rotatably supporting the motor, in which a second blowing path to be combined with the first blowing path is formed on an outside of an outer peripheral end of the centrifugal fan in the radial direction, the plurality of exhaust holes partitioned by beams between a bottom outer peripheral wall and a bottom inner peripheral wall of the second case and for exhausting the compressed air to an outside of the case body are drilled at a bottom portion of the second flowing path provided in the second case in a circumferential direction at prescribed intervals in an annular blowing path formed by combining the first case and the second case around the outer side in the radial direction of the case body, and a diffuser having diffuser plates inclined diagonally downward with respect to a rotation direction of the centrifugal fan and provided at prescribed intervals, the diffuser provided at a position facing the exhaust holes, wherein the diffuser plates have an upstream end line in an exhaust direction provided so as to cross the center of a rotation axis of the centrifugal fan in plan view in the axial direction, and an downstream end line in the exhaust direction provided so as to be parallel to the upstream end line and not to cross the center of the rotation axis of the centrifugal fan.

2. The centrifugal blower according to claim 1, wherein the diffuser is provided integrally with the second case, in which the diffuser plates are arranged so that the diffuser plates adjacent in the circumferential direction of the second case do not overlap one another in plan view in the axial direction.

3. The centrifugal blower according to claim 1, wherein the diffuser is provided integrally with the second case, in which the diffuser plates are arranged so that the diffuser plates adjacent in the circumferential direction of the second case overlap one another in plan view in the axial direction.

4. The centrifugal blower according to claim 1, wherein an upstream end portion in an exhaust direction of each diffuser plate forming the diffuser is chamfered.

5. The centrifugal blower according to claim 1, wherein each diffuser plate forming the diffuser has a skew shape shifted by a prescribed amount in the rotating direction of the centrifugal fan with respect to the radial direction.

6. The centrifugal blower according to claim 1, wherein the centrifugal fan is configured so that a hub assembled integrally with an upper surface portion of a rotor yoke, and a main plate continuing from the hub on the outer side in the radial direction are formed in a dome shape, a plurality of impeller blades are formed to stand on the main plate in the circumferential direction at prescribed intervals, and a shroud annularly connecting outer peripheral edge portion of respective impeller blades is formed.

7. The centrifugal blower according to claim 1, wherein a hub assembled so as to be integrated with an upper surface portion of a rotor yoke of the centrifugal fan and a main plate continuing from the hub on the outer side in a radial direction are extended to be inclined to a downstream side in a blowing direction, and the motor is housed in an overlapping manner in the axial direction in a dome-shaped space formed on an opposite surface side of the opening for air supply with respect to the hub and the main plate.

8. The centrifugal blower according to claim 1, wherein the centrifugal fan is configured so that a plurality of curved blades of the impeller are formed to stand on a main plate from an inner side to the outer side in the radial direction, and that blades of a sub-impeller are each formed to stand on the main plate at the outer peripheral edge portion between adjacent blades of the plurality of curved blades of the impeller.

* * * * *